United States Patent [19]

Tax

[11] 4,076,128

[45] Feb. 28, 1978

[54] ROTARY CRANE

[76] Inventor: Hans Tax, Potsdamer Str. 3, Munich 40, Germany, 8000

[21] Appl. No.: 721,664

[22] Filed: Sep. 9, 1976

[30] Foreign Application Priority Data

Sep. 15, 1975 Germany ..... 2541065

[51] Int. Cl.[2] ..... B66C 23/72; B66C 23/52

[52] U.S. Cl. ..... 212/48; 212/3 R; 212/58 R; 212/66

[58] Field of Search ..... 212/3, 66, 67, 68, 69, 212/38, 48, 49, 58 R, 59 R; 214/13

[56] References Cited

U.S. PATENT DOCUMENTS

| | | | |
|---|---|---|---|
| 723,731 | 3/1903 | Reise | 212/69 |
| 2,035,385 | 3/1936 | McLean | 212/68 |
| 2,513,726 | 7/1950 | Huston | 212/69 |

*Primary Examiner*—Lawrence J. Oresky
*Attorney, Agent, or Firm*—Hans Berman

[57] ABSTRACT

In a rotary crane whose boom has two longitudinal members pivotally fastened to a turntable in transversely spaced relationship and converging radially outward from the upright turntable axis toward respective outer terminal portions fastened to each other, two of the several undercarriage assemblies depending from the turntable for movement along a circular track are fastened to the turntable below the fastened terminal portions of the boom members, and compression members of a column extend upward and rearward from the junction of the boom members with the turntable. The boom is held in its angular position by a tension member whose end portions are fastened to the column and to the outer terminal portions of the boom member, a load may be hoisted by varying the effective length of a hoisting cable trained from the column over the outer end of the boom, and a counterweight is mounted on the turntable diametrically opposite the boom. The direct transmission of operating stresses from the boom and the column to the subjacent undercarriage assemblies and the track without significant flexural stresses makes the crane suitable for particularly heavy loads.

10 Claims, 5 Drawing Figures

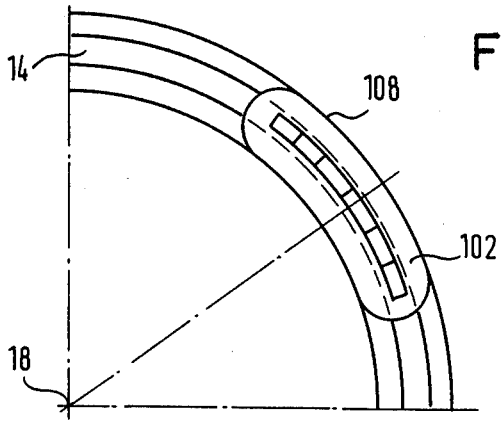
Fig.4
Fig.5
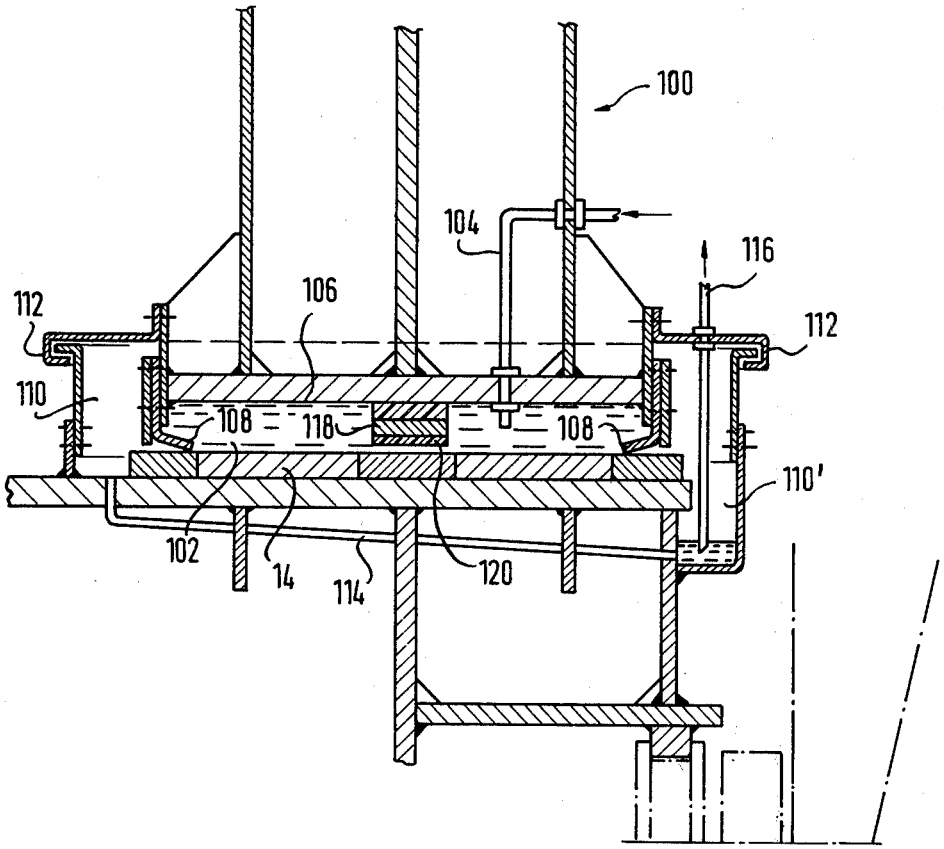

ROTARY CRANE

This invention relates to rotary cranes, and particularly to rotary cranes capable of lifting very heavy loads.

In its more specific aspects, the invention is concerned with improvements in a crane of the type disclosed in the German published application 2,324,940. The known crane has a base carrying a circular track. Several undercarriages move on the track to rotate a turntable from which two boom members converge toward their connected outer ends. A cable securing the composite boom in a desired angular position is trained from a winch over the column to the outer boom end, and a hoisting cable similarly extends from a winch on the turntable over the column to the outer end of the boom from which it depends toward the load to be hoisted. The arrangement of the several elements of the crane superstructure is such that the load-bearing capacity of the crane is limited in part by bending stresses in the several elements mounted on the turntable, and by bending stresses in the turntable itself.

It is an object of this invention to modify the known crane in such a manner that bending stresses are held to a minimum, thereby permitting heavier loads to be lifted by a crane of similar weight, or a crane of equal lifting capacity to be made lighter than an equivalent known crane.

According to the invention, two load-bearing portions of the column have respective bottom ends secured to the turntable contiguously adjacent the common horizontal axis about which the two boom members pivot on the turntable, and contiguously adjacent the inner terminal portions of the boom members. The afore-mentioned load-bearing portions of the column extend from the common horizontal axis of the boom members upward and horizontally away from the boom. Two undercarriage assemblies have portions vertically substantially aligned with respective bottom ends of the column portions and respective inner ends of the two boom members and are fastened to the turntable for pivotal movement about respective axes radial relative to the upright axis of turntable rotation.

Other features, additional objects, and many of the attendant advantages of this invention will readily be appreciated as the same becomes better understood by reference to the following detailed description of a preferred embodiment and of a modification of the same, when considered in connection with the appended drawing in which:

FIG. 4 shows a modified detail for use in the crane of FIG. 1 in a fragmentary top plan view; and FIG. 5 shows a portion of the device of FIG. 4 in elevational section.

Figure 1:
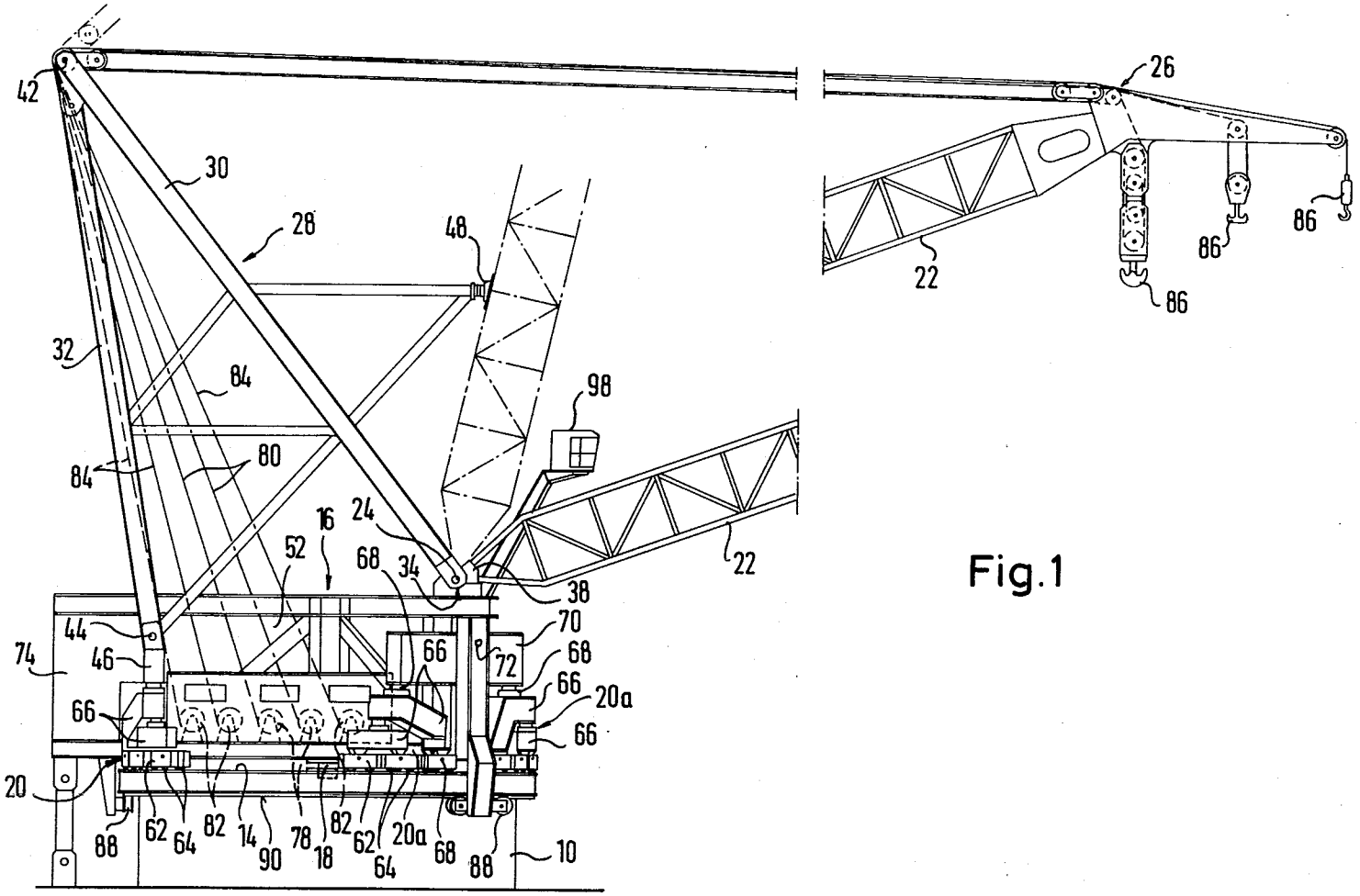
FIG. 1 shows a rotary crane of the invention in fragmentary side elevation.
Figure 2:
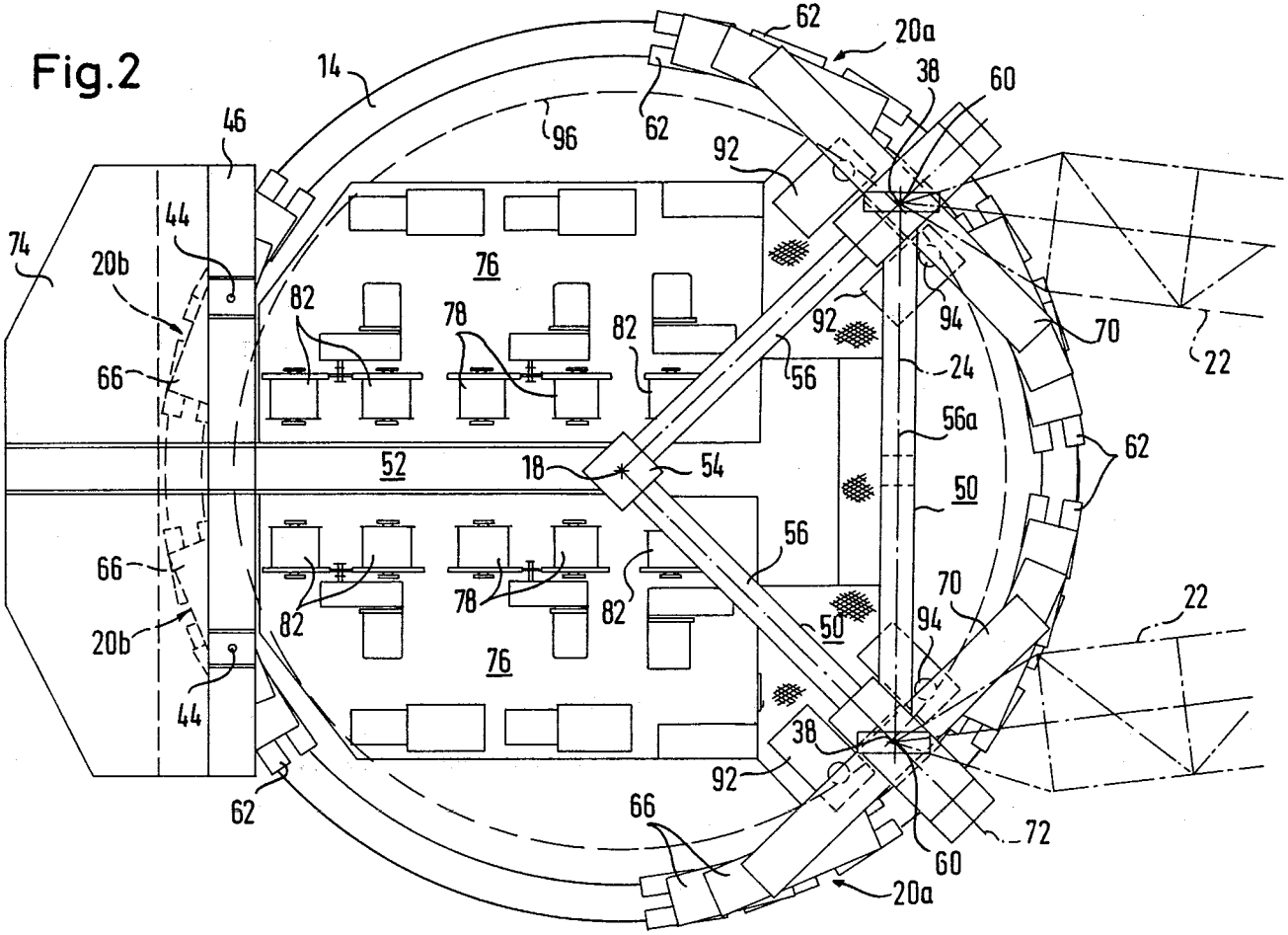
FIG. 2 shows the turntable and associated elements of the crane of FIG. 1 in top plan view.
Figure 3:
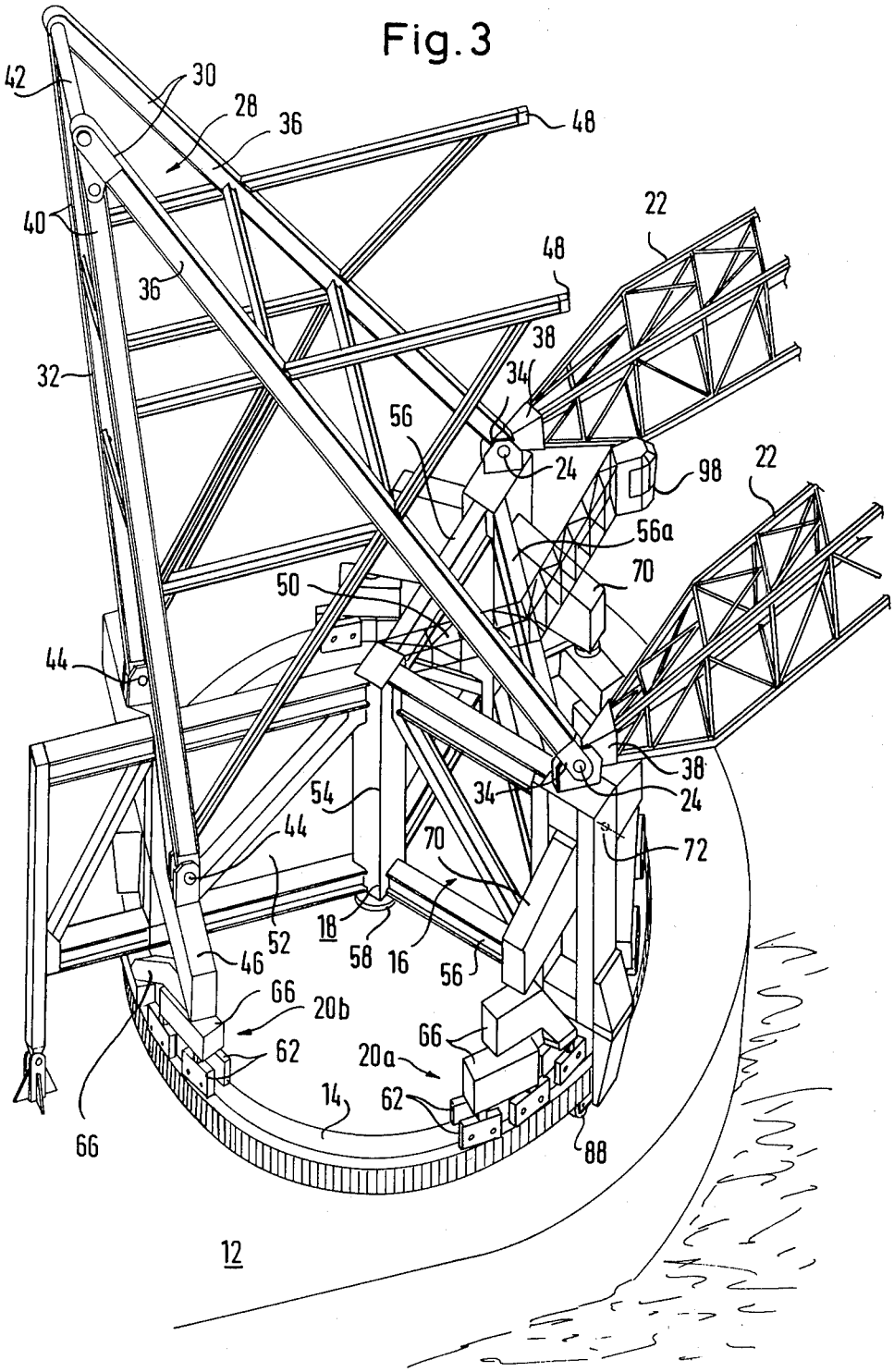
FIG. 3 is a perspective view of the principal elements of the same crane.

Referring now to the drawing in detail, and initially to FIGS. 1 to 3, there is seen a rotary crane of the invention whose base 10 is mounted on the deck of a barge 12 for heavy-duty harbor service. A circular track 14 on the base 10 guides rotation of a turntable 16 about an upright axis 18, four undercarriage assemblies 20 depending from the turntable 16 to the track 14.

The boom 22 of the crane consists essentially of two elongated lattice girders whose radially inner ends near the axis 18 are transversely spaced from each other and attached to the turntable 16 for pivoting movement about a common axis defined by pivot shafts 24. The two girders converge toward the outer end 26 of the boom in which they are fixedly fastened to each other.

A skeleton column 28 upwardly projects from the turntable 16. It is a girder having a compression chord 30 and a tension chord 32. The compression chord 30 extends from the turntable 16 obliquely upward and horizontally away from the boom 22. The bottom ends 34 of the two bars 36 which are transversely spaced from each other and constitute the principal load-bearing members of the compression chord 30 are pivoted to the turntable 16 by the pivot shafts 24, and are thus contiguously adjacent respective inner ends 38 of the boom members 22. The upper ends of the two transversely spaced tension bars 40 which constitute the principal load-bearing elements of the tension chord 32 are connected with the upper ends of the compression bars 36 by a horizontal shaft 42. The bottom ends 44 of the tension bars 40 are hingedly fastened to a horizontal member 46 of the turntable 16.

Two bumpers 48 project from the column 28 into the path of the boom members 22 to limit the angular upward movement of the boom.

As is best seen in FIGS. 2 and 3, the turntable 16 consists mainly of a frame part 50 having the shape of a right, rectangularly triangular prism and of a plate-shaped frame part 52. A side edge member 54, in which the equal leg portions 56 of the prism merge, is common to both parts and extends along the upright axis 18 of turntable rotation. The edge member 54 is supported by a bearing 58 for centering the turntable. The other two upright edge members 60 of the turntable part 50 support the inner ends 38 of the two boom members 22 and the bottom ends 34 of the compression bars 36.

Two undercarriage assemblies **20*a* are associated with the boom 22. They each have six trucks 62 whose wheels roll on the track 14 during rotation of the turntable 16. The trucks 62 are connected by superposed equalizer blocks 66 secured by pivots 68 having horizontal axes (see FIG. 1). The two topmost equalizing blocks 66 of each undercarriage assembly are in turn connected hingedly by a balancer block 70 attached to an outer edge member 60 of the turntable part 50 by a pivot shaft 72 whose axis is radial relative to the upright axis 18 of turntable rotation, and which is vertically aligned with an inner boom member end 38, the associated bottom end 34 of a compression bar 36, and the associated shaft 24**.

Because each boom member 22 and the associated pressure bar 36 of the column 28 are precisely superimposed on a corresponding undercarriage assembly **20*a*, practically all stresses generated in the boom 22 and in the column 28 during operation of the crane are transmitted as vertical compression stresses directly to the undercarriage assembly. Because the several trucks 62 of each assembly 20*a* are hingedly connected with the turntable 16 by the equalizer and balancing blocks 66, 70, the vertical stresses are uniformly transmitted by the several wheels 64 to the track 14 and thus to the base 10. In the absence of significant bending stresses, the turntable does not need to be made very rigid. The specifically disclosed prismatic part 50 of the turntable 16 is adequate if its side 56*a***, defined by the bases of the isoceles, rectangular triangles at the top and bottom of the prism, has sufficient rigidity to absorb such secondary horizontal stresses as may be caused by listing of the load, wind pressure, and inertial effects.

It has been found advantageous that the axes of the two pivot shafts 72 diverge from the upright axis 18 of turntable rotation at an angle of at least 60°. In the illustrated embodiment, the angle is 90°, and all other elements of the crane are correspondingly dimensioned.

The plate-shaped turntable part 52 extends in a common plane with the axis of rotation 18 and the outer end 26 of the boom 22. It is fastened to the rigid horizontal member 46 to which the tension bars 40 are fastened, but its shape provides relatively little flexural strength. Two undercarriage assemblies **20*b* depend from the ends of the member 46 symmetrically relative to a plane through the axis 18 and the boom end 26. They each consist of wheel-carrying trucks 62, and equalizer blocks 66, the latter being directly attached to the member 46 for tilting movement about axes radial relative to the axis of rotation 18. The angular spacing of these axes is preferably smaller than 60°, and is approximately 45° in the illustrated crane, as is evident from the location of the bottom ends 44 of the tension bars 40 best seen in FIG. 2. The tilting axes of the assemblies 20*b* on the horizontal turntable member 46 are downwardly aligned with the bottom ends 44 respectively. The turntable part 52 also carries a counterweight 74 conventional in itself and shown in FIGS. 1 and 2** only.

Two housings 76 are attached to the upright sides of the turntable part 52. They are mirror images of each other. Each encloses two motor driven winches 78 for cables or other tension members 80 trained over pulleys on the shaft 42 and attached to the outer end 26 of the boom 22. Three winches 82 in each machinery housing 76 control the respective lengths of hoisting cables 84 trained over pulleys on the shaft 42 and on the outer boom end 26 and depending from the boom to load hooks 86.

Tilting of the turntable 16 on the track 14 is prevented by retaining rollers 88 associated with each undercarriage assembly 20 and engaging a downwardly directed track 90 on the base 10 subjacent the track 14. The turntable 16 is moved about the axis 18 by means of two drive motors 92 on each undercarriage assembly **20*a* (see FIG. 2). A pinion 94 on the output shaft of each motor 92 meshes with a circular rack 96 coaxial with the track 14 on the base 10. The winches in the housings 76, the motors 92, and other elements of the crane, not specifically illustrated and conventional in themselves, are controlled by an operator in a cab 98 mounted between the girders of the boom 22**.

The term "contiguous" as employed in this specification and the appended claims does not necessarily imply direct contact between contiguously adjacent elements. Thus, the bottom ends 34 of the compression bars 36 need not be fastened to the turntable 16 by means of the pivot shafts 24 sufficiently to avoid flexural stresses in the crane, as long as they are very closely adjacent the inner terminal portions 38 of the boom girders and are at least approximately vertically aligned with the portions of the associated undercarriage assemblies which are directly fastened to the turntable by the shafts 72.

The wide angular spacing of the two undercarriage assemblies **20*a* associated with the boom 20 is important for preventing toppling of the crane under asymmetrical loading, as by strong wind, and may be selected otherwise than as illustrated in locations where strong winds need not be taken into consideration. If the turntable of the crane must be reinforced against flexural stresses not directly related to the hoisting operation, it may not be necessary to align the bottom ends 44 of the tension bars 40 with the undercarriage assemblies 20*b*** in the manner described above. Such alignment reduces flexural stresses during normal crane operation and is instrumental in permitting the weight of the crane to be held to a minimum, as is particularly important with boat mounted cranes.

On the basis of the same considerations, not necessarily applicable in all instances, it has been found important to concentrate all normal flexural stresses exerted on the turntable 16 in the prismatic part 50 while the plate-shaped part 52 may be built light because it need not absorb significant flexural stresses and may deform somewhat under such stresses without affecting the operation of the crane.

Structural modifications of the illustrated example of the invention, unrelated to the variables discussed in the immediately preceding paragraphs, may be resorted to under suitable conditions. One modification that has been found advantageous in some instances is shown in FIGS. 4 and 5.

In the otherwise unchanged crane of FIGS. 1 to 3, each undercarriage assembly 20 is replaced by a hydraulic carrier unit 100 which travels on cushions 102 of pressurized liquid, such as hydraulic brake fluid, downwardly confined by the track 14. The liquid is held under sufficient pressure by a nonillustrated pump to balance the weight of the turntable and of elements mounted on the turntable which rests on a plate 106 upwardly confining each cushion 102.

The opposite horizontal surfaces of the track 14 and of the plate 106 are connected by partly resilient aprons 108 attached to the plate 106 and movably engaging the track 14, the sealing lips of the apron being backed by the pressure fluid of the cushion. Fluid leaking under the apron 108 is collected in annular troughs 110, 110′ on either side of the track. Labyrinth seals 112 connecting the moving plate 106 to the fixed track 14 prevent contamination of the liquid in the troughs which are connected by a line 114 for return of the leaking oil to the nonillustrated pump from the lowermost trough 110′ through a suction line 116.

Damage to the crane during malfunctioning of the hydraulic suspension system is prevented by slides 118 circumferentially spaced about the axis of turntable rotation and axially interposed between the turntable, not itself seen in FIGS. 4 and 5, and the track 14 in the several cushions 102. As is evident from FIG. 5, each slide 118 is fastened to the plate 106 and dimensioned for being spaced from the track 14 as long as sufficient pressure is maintained in the hydraulic fluid by the pump represented in FIG. 5 only by its pressure and suction lines 104, 116. The strength of the slides is sufficiently high that they do not suffer structural failure in compression in the event of a breakdown in the hydraulic system when they are called upon to transmit the full weight of the turntable and of all elements mounted thereon to the track 14.

A plastic bottom layer 120 of each slide 118 together with residual hydraulic fluid may reduce friction sufficiently to permit some angular movement of the crane on the track 14 by the motors 90 in an emergency.

It should be understood, of course, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. A rotary crane comprising, in combination:
(a) a base carrying a track circular about an upright axis;
(b) a turntable;
(c) a plurality of undercarriage assemblies mounted on said turntable for movement along said track,
(1) a first and second undercarriage assembly having respective portions fastened to said turntable for pivotal movement about respective pivot axes radial relative to said upright axis;
(d) a boom including two elongated boom members having respective first, longitudinally terminal, transversely spaced portions fastened to said turntable for pivoting movement about a common horizontal axis,
(1) said boom members converging from said first terminal portions thereof in a radially outward direction relative to said upright axis toward respective second terminal portions fastened to each other;
(e) a column upwardly projecting from said turntable,
(1) two load-bearing members of said column having respective bottom ends secured to said turntable contiguously adjacent said common horizontal ais and said first terminal portions respectively and extending from said common axis obliquely upward and opposite to said radially outward direction,
(2) said portions of said first and second undercarriage assemblies being substantially aligned vertically with respective ones of said first terminal portions and of said bottom ends,
(3) a part of said turntable having the shape of a right triangular prism including one edge member extending substantially along said upright axis, and two other side members connecting said bottom end and said first terminal portions to said first and second undercarriage assemblies;
(f) a tension member having respective end portions fastened to said column and to said second terminal portions for maintaining a desired angular position of said boom relative to said common axis;
(g) a flexible hoisting member extending from said column to said second terminal portions and depending from said second terminal portions for receiving a load;
(h) winch means for varying the effective lengths of said tension member and of said hoisting member; and
(i) a counterweight on said turntable spaced from said upright axis in a direction away from said boom.

2. A crane as set forth in claim 1, wherein said pivot axes are angularly offset at least 60° from each other relative to said upright axis.

3. A crane as set forth in claim 2, wherein a third one of said undercarriage assemblies is fastened to a portion of said turntable spaced from said upright axis opposite to said radially outward direction.

4. A crane as set forth in claim 2, wherein a third and a fourth undercarriage assembly are fastened to a portion of said turntable spaced from said upright axis opposite to said radially outward direction for tilting movement about respective tilting axes radial relative to said upright axis, said tilting axes bounding an angle of less than 60° approximately bisected by a vertical plane defined by said upright axis and said fastened second terminal portions.

5. A crane as set forth in claim 4, wherein said column has two additional members having respective bottom ends secured to said portion of said turntable in approximate vertical alignment with said tilting axes and said third and fourth undercarriage assemblies respectively.

6. A crane as set forth in claim 1, further comprising a bearing interposed between said one edge member and said base.

7. A crane as set forth in claim 1, wherein another part of said turntable has the shape of an upright plate extending from said one edge member in a direction away from said boom, a portion of said other turntable part remote from said upright axis being fastened to said counterweight.

8. A crane as set forth in claim 7, wherein said turntable further includes a horizontal member having two parts projecting from said upright plate in opposite directions, a third undercarriage assembly and a fourth undercarriage assembly being secured to said projecting parts respectively for tilting movement about tilting axes substantially radial relative to said upright axis, the torsion resistance of said other part of the turntable being smaller than the torsion resistance of said prism-shaped part, said horizontal member being more rigid than said other turntable part.

9. A rotary crane comprising, in combination:
(a) a base carrying a track circular about an upright axis;
(b) a turntable;
(c) a plurality of undercarriage assemblies mounted on said turntable for movement along said track,
(1) a first and a second undercarriage assembly having respective portions fastened to said turntable for pivotal movement about respective pivot axes radial relative to said upright axis;
(d) a body of liquid vertically interposed between each of said undercarriage assemblies and said track;
(e) pressure means for maintaining in said body a liquid pressure sufficient for preventing direct, load transmitting contact between said assemblies and said track;
(f) a boom including two elongated boom members having respective first, longitudinally terminal, transversely spaced portions fastened to said turntable for pivoting movement about a common horizontal axis,
(1) said boom members converging from said first terminal portions thereof in a radially outward direction relative to said upright axis toward respective second terminal portions fastened to each other;
(g) a column upwardly projecting from said turntable,
(1) two load-bearing members of said column having respective bottom ends secured to said turntable contiguously adjacent said common horizontal axis and said first terminal portions respectively and extending from said common axis obliquely upward and opposite to said radially outward direction,
(2) said portions of said first and second undercarriage assemblies being substantially aligned vertically with respective ones of said first terminal portions and of said bottom ends;

(h) a tension member having respective end portions fastened to said column and to said second terminal portions for maintaining a desired angular position of said boom relative to said common axis;

(i) a flexible hoisting member extending from said column to said second terminal portions and depending from said second terminal portions for receiving a load;

(j) winch means for varying the effective lengths of said tension member and of said hoisting member; and (k) a counterweight on said turntable spaced from said upright axis in a direction away from said boom.

10. A crane as set forth in claim 9, further comprising a plurality of slides circumferentially spaced about said upright axis and interposed between said turntable and said track in the direction of said upright axis, each slie being dimensioned for being spaced from at least one of said turntable and said track when said sufficient pressure is maintained in said body of liquid by said pressure means, but of a strength sufficient not to fail structurally when transmitting the weight of said turntable to said track in the event of breakdown of said pressure means.

* * * * *